US010280650B2

(12) United States Patent
Duval

(10) Patent No.: US 10,280,650 B2
(45) Date of Patent: May 7, 2019

(54) DEVICE AND METHOD FOR CONTROLLING ACCESS

(71) Applicant: Cubex LLC, Phoenix, AZ (US)

(72) Inventor: John A. Duval, Long Beach, CA (US)

(73) Assignee: Cubex LLC, Phoenix, AZ (US)

( * ) Notice: Subject to any disclaimer, the term of this patent is extended or adjusted under 35 U.S.C. 154(b) by 814 days.

(21) Appl. No.: 14/802,529

(22) Filed: Jul. 17, 2015

(65) Prior Publication Data

US 2017/0016254 A1 Jan. 19, 2017

(51) Int. Cl.

| | |
|---|---|
| ***E05B 65/46*** | (2017.01) |
| ***E05B 65/06*** | (2006.01) |
| ***E05C 1/08*** | (2006.01) |
| ***E05B 65/462*** | (2017.01) |

(52) U.S. Cl.
CPC ..... *E05B 65/462* (2013.01); *E05B 65/06* (2013.01); *E05C 1/08* (2013.01)

(58) Field of Classification Search
CPC ..... E05B 65/462; E05B 65/06; E05C 1/08
USPC ..... 700/231–244; 221/92, 123–125
See application file for complete search history.

(56) References Cited

U.S. PATENT DOCUMENTS

| | | | | |
|---|---|---|---|---|
| 1,847,106 | A | 3/1932 | Turner | |
| 3,150,902 | A * | 9/1964 | Naab | E05B 65/462 312/217 |
| 3,259,444 | A | 7/1966 | Friend | |
| 3,318,646 | A | 5/1967 | Ibel | |
| 3,371,974 | A | 3/1968 | Vermeersch | |
| 4,615,572 | A * | 10/1986 | Nelson | A47B 88/402 312/334.4 |
| 4,785,969 | A | 11/1988 | McLaughlin | |
| 5,014,875 | A | 5/1991 | McLaughlin et al. | |
| 5,445,294 | A * | 8/1995 | Gardner | E05B 65/46 221/1 |
| 5,745,366 | A | 4/1998 | Higham et al. | |
| 5,805,455 | A | 9/1998 | Lipps | |
| 5,805,456 | A | 9/1998 | Higham et al. | |
| 5,862,689 | A * | 1/1999 | Wen | E05B 65/465 292/DIG. 18 |
| 5,905,653 | A | 5/1999 | Higham et al. | |
| 5,927,540 | A | 7/1999 | Godlewski | |
| 5,940,306 | A | 8/1999 | Gardner et al. | |
| 5,992,709 | A | 11/1999 | Gray | |
| 6,011,999 | A | 1/2000 | Holmes | |
| 6,039,467 | A | 3/2000 | Holmes | |

(Continued)

FOREIGN PATENT DOCUMENTS

WO WO 2017/015066 1/2017

*Primary Examiner* — Michael Collins
(74) *Attorney, Agent, or Firm* — Levine Bagade Han LLP

(57) ABSTRACT

Devices and methods for controlling access are described herein where such an assembly may generally comprise an index plate defining one or more spaces over a surface of the plate and each of the one or more spaces having a corresponding protrusion extending within, a first actuator configured to translate the plate in a first direction, and a second actuator configured to translate the plate in a second direction different from the first direction. The one or more lever arms may correspondingly extend from a locking mechanism and the one or more spaces, wherein selective engagement of a single lever arm by a corresponding single protrusion actuates the single lever arm from a locked configuration to an unlocked configuration.

20 Claims, 16 Drawing Sheets

(56) References Cited

U.S. PATENT DOCUMENTS 6,109,774 A 8/2000 Holmes et al.
6,116,461 A 9/2000 Broadfield et al.
6,338,007 B1 1/2002 Broadfield et al.
6,339,732 B1 1/2002 Phoon et al.
6,347,848 B1 * 2/2002 Cho ..... E05B 65/462 292/DIG. 18
6,418,416 B1 7/2002 Rosenberg et al.
6,511,138 B1 * 1/2003 Gardner ..... E05B 65/462 312/217
6,572,203 B1 6/2003 Cheng
6,609,047 B1 8/2003 Lipps
6,640,159 B2 10/2003 Holmes et al.
6,648,153 B2 11/2003 Holmes
6,760,643 B2 7/2004 Lipps
7,142,944 B2 11/2006 Holmes et al.
7,178,688 B2 2/2007 Naufel et al.
7,228,200 B2 6/2007 Baker et al.
7,249,688 B2 7/2007 Hunter et al.
7,588,167 B2 9/2009 Hunter et al.
7,630,789 B2 12/2009 Broadfield et al.
7,630,791 B2 12/2009 Nguyen et al.
7,657,344 B2 2/2010 Holmes et al.
7,668,620 B2 2/2010 Shoenfeld
7,693,603 B2 4/2010 Higham
7,946,663 B2 * 5/2011 Holcomb ..... E05B 65/46 312/217
7,992,746 B2 8/2011 Weber
8,061,790 B2 * 11/2011 Anikhindi ..... F25D 25/025 312/319.5
8,065,035 B2 11/2011 Ross et al.
8,090,473 B2 1/2012 Higham
8,121,725 B2 2/2012 Baker et al.
8,180,484 B2 5/2012 Baker et al.
8,197,017 B2 6/2012 Rahilly
8,262,174 B2 9/2012 Rahilly
8,335,588 B2 12/2012 Rahilly et al.
8,428,775 B2 4/2013 Baker et al.
8,467,897 B2 6/2013 Holmes et al.
8,517,215 B2 8/2013 Shafir
8,554,364 B2 10/2013 Holmes et al.
8,706,294 B2 4/2014 Rahilly et al.
8,744,620 B2 6/2014 Shavelsky et al.
8,749,379 B2 6/2014 Muecke et al.
8,983,653 B2 * 3/2015 Barrett ..... G06F 19/3462 700/237
9,260,889 B2 * 2/2016 Stijns ..... E05B 65/465
9,295,331 B2 * 3/2016 Slogoff ..... E05B 47/0012
9,355,222 B2 5/2016 Chudy et al.
2004/0108795 A1 6/2004 Meek et al.
2007/0228899 A1 10/2007 McFarland
2011/0101018 A1 5/2011 Shafir
2012/0200213 A1 * 8/2012 Savage ..... E05B 1/0092 312/326
2013/0030566 A1 1/2013 Shavelsky et al.
2013/0112703 A1 5/2013 Shoenfeld
2014/0021843 A1 * 1/2014 Hashemi ..... E05B 47/0001 312/333
2014/0166598 A1 6/2014 Bird et al.
2014/0326746 A1 11/2014 Miedema
2016/0270534 A1 9/2016 Duval et al.
2016/0324314 A1 11/2016 Duval et al.

* cited by examiner

DEVICE AND METHOD FOR CONTROLLING ACCESS

FIELD OF THE INVENTION

The present invention relates to devices and methods for controlling access to items from a dispensing cabinet or locker configuration. More particularly, the present invention relates to devices and methods for controlling access to selected items from a secured locker or container using a selector index plate.

BACKGROUND OF THE INVENTION

In facilities where supplies need to be securely stored for use by employees, such as manufacturing plants, hospitals, offices, etc., it is desirable to hold selected items in secure storage locations. Traditionally this would be a locked storage room, or a managed storage room where a responsible party would record items taken and by whom. More recently automated storage cabinets have been introduced, which present a user interface requiring secure identification of the person accessing the cabinet, and selective unlocking of locations on that cabinet to restrict the user to just one type of item, or, where more security is required to an individual item, so that each individual item can be identified with the person who took it. The processor on each cabinet is programmable to monitor the access to the items in these fixed cabinets, allowing the current on hand inventory and the need for replenishment to be communicated to a central processor at the central pharmacy and supply storage locations.

When a user logs into the cabinet's processor, they are typically given access to multiple items, stored behind locked doors or drawers, that selectively unlock. Amongst the many items that can be stored in a cabinet, for certain items, it is desirable to limit access to just a single item type, so the processor can record exactly which items were available to the user to be taken. This is particularly true of expensive items in a manufacturing, maintenance, office or clinical environment, or items that might be desirable for user to divert for their own use such as narcotic medications in a clinic, hospital or pharmacy. In some cases, it is desirable to limit access to one individual item at a time. These more secure process are achieved by storing items in bins within locked drawers for small items, and behind locked doors in a locker configuration for larger items. The system then allows controlled access to individual bins or locker doors to each user, such as a maintenance or production worker in a manufacturing environment, a nurse in a clinical environment, or an employee in an office. The user will typically enter their own personal identification (ID) and the ID for the specific account to be charged whether that is a job number, a department, or a charge to an individual in a retail or hospital environment where a customer or patient is to be billed. Specified drawers and bins or locker doors may then be unlocked to provide access to the specified item or items. However, while allowing access to certain items, these cabinets may still prohibit access to other bins or doors to which the user may be restricted from accessing.

In order to limit access to specified lockers or bins, the lids or locker doors on each individual compartment must be able to lock and unlock when specified and must also be able to do so repeatedly without failure. This selective locking of the lids typically requires the use of various software systems to track user access and further requires mechanical, electrical, or electro-mechanical mechanisms such as solenoids integrated with each individual bin.

Because of the repeated locking and unlocking of individual containers, the tracking of user access, many of these locking mechanisms are subject to failure resulting in lids or doors which may not lock or unlock properly when needed or resulting in the incorrect lids or doors locking or unlocking improperly. Alternatively, the resulting system may be overly complex and difficult to repair or maintain. In addition to the issue of reliability, the need for a separate electromechanical device for each locked location is costly.

Thus, a system which allows for the tracking as well as locking and unlocking of selected lids or doors from a cabinet in an efficient, reliable, and repeatable manner is desired.

SUMMARY OF THE INVENTION

The mechanisms described for the controlled items may be incorporated in any number of dispensing cabinets that are generally utilized in facilities where the automated tracking and dispensation of items is tightly controlled or regulated. These cabinets may incorporate one or more containers which are each locked by a corresponding door. Such an assembly may generally comprise a housing for holding and positioning a plurality of containers aligned in a matrix array.

Generally a cabinet enclosed by a housing may contains one or more individual storage containers which are arranged in a vertically stacked configuration such that access is provided by doors which may be opened along a side of the cabinet. Such cabinets may optionally incorporate a user interface such as a touchscreen as well as a keyboard or other user input device which is in communication with a processor. Additionally, an automated identification interface, e.g., magnetic card reader, bar code reader, fingerprint reader (or other biometric identification device), etc., may also be optionally incorporated and in communication with the processor.

One variation of an apparatus for selective actuation may generally comprise an index plate defining one or more spaces over a surface of the plate, wherein each of the one or more spaces has a corresponding protrusion extending within, a first actuator configured to translate the plate in a first direction, a second actuator configured to translate the plate in a second direction different from the first direction, and one or more lever arms which correspondingly extend from a locking mechanism and the one or more spaces, wherein selective engagement of a single lever arm by a corresponding single protrusion actuates the single lever arm from a locked configuration to an unlocked configuration.

Such an apparatus may have the one or more protrusions define one or more rows which are arranged upon the plate in a collinear arrangement, and may also have the one or more protrusions further define one or more columns which are arranged upon the plate at an angle such that each protrusion is off-set relative to an adjacent protrusion along the column.

In use, one method for selective actuation may generally comprise translating an index plate in a first direction in proximity to one or more containers arranged relative to one another and each having a corresponding lever arm, wherein the index plate defines one or more spaces over a surface of the plate and wherein each of the one or more spaces has a corresponding protrusion extending within, aligning a single protrusion relative to a single lever arm along a first direction, and translating the index plate in a second direction transverse to the first direction such that the single protrusion engages with the single lever arm.

The one or more protrusions may further define one or more columns which are arranged upon the plate at an angle such that each protrusion is off-set relative to an adjacent protrusion along the column.

An individual storage container may be selectively unlocked to allow access to this individual container while the other containers remain locked and a second storage container may be unlocked as well while the first container is locked. While a 3×3 array of vertically arranged containers may be used, other cabinet configurations may be utilized in various different array configurations as well. Additionally and/or optionally, each of the containers or a select number of containers may incorporate one or more sensors, as known in the art, which may communicate with the processor to sense, detect, and/or track which drawers, doors, or lids are being accessed by the user.

When in use, a user may for instance enter their identification or some other entry code or feature (e.g., password, passcode, RFID, NFC, etc.) through a user interface in communication with the processor. Once the user gains electronic entry to the system, one or more particular items in a corresponding container may be unlocked to provide access to the previously locked item and access may be provided to the user only to one or more individual containers by unlocking only those individual containers while maintaining the remaining containers in a locked state to restrict their access.

The unlocking of selected individual containers may be accomplished by one or more selector index plate assemblies which may effectively and efficiently seek and unlock a selected container, as described in further herein. The use of a selector plate assembly and variations of the plate assembly may be utilized in any number of storage applications where the release of the stored contents is to be controlled.

Each of the individual containers may have a locking door each pivotably coupled to the housing via a corresponding hinge. Moreover, each of the containers may also incorporate a trigger lever which extends from the locking mechanism and to an index plate positioned proximally of the containers. The trigger lever may comprise an elongate member or structure such as a tubular-shaped member which is positioned along an outer surface of each container while held against the outer surface via one or more trigger lever supports which hold the trigger lever while also allowing the lever to rotate about its longitudinal axis when actuated.

The proximal end of the trigger lever may be configured to bend or curve to form a transverse arm which extends at an angle, e.g., 90 degrees, relative to a longitudinal axis of the lever. The proximal end of the transverse arm may bend or curve again, e.g., 90 degrees, relative to the transverse arm to form a trigger release arm which may project in parallel to the lever. It is the trigger release arm which may interface and engage with the index plate for actuating the trigger lever (described in further detail herein). The index plate may form transverse arm receiving spaces over the plate which correspond to each trigger lever extending from each respective container.

The index plate may comprise a flat plate having a width and a height which is sized to extend along the width and height of the array of containers such that the index plate is positioned proximally of the containers. Such an index plate may be fabricated from any number of materials, e.g., steel, plastic, aluminum, wood, composites, etc. The index plate may be positioned such that the plate extends vertically while parallel with the containers although the index plate may be angled relative to the containers if so desired. An interface plate may be formed as part of the index plate or attached as a separate portion in proximity to one or more actuators which are used to translate and position the index plate relative to the containers.

A first actuator (e.g., selector motor and encoder) may be mounted or secured relative to the housing and may have a selector gear attached for engagement with a gear rack positioned upon the interface plate or the index plate itself. The selector gear may be rotatably coupled to the first actuator and the gear rack may be positioned near or at an edge of the index plate such that the gear rack extends at least partially along the width of the index plate. A second actuator may also be mounted or secured relative to the housing to function as a release actuator and may have a cam attached also for engagement with the interface plate. Additionally, one or both of the actuators may be in communication with a controller or processor for controlling the positioning of the index plate when actuated. The controller or processor (which may be locally or remotely located from the cabinet) may be in communication with each respective actuator. For instance, the controller or processor may be in wired or wireless communication with the first actuator and may also be in wired or wireless communication with the second actuator.

With respect to the index plate, the plate may have a number of spaces which correspond to the number of containers. The positioning of the spaces may also correspond to the proximal position of the containers. Generally, each of the spaces are large enough so that translation of the plate allows for the unhindered movement of the plate relative to each of the trigger release arms which extend through each of the spaces. Each of the transverse arm receiving spaces comprises a projection or shoulder which extends within the space at a preselected position. For instance, a first column of spaces over the index plate may have projections which extend within each space and off set relative to one another. The positioning of the projections may be placed along an angle defined between the vertical axis of the index plate and the line adjoining each of the projections within the first column of spaces. A second column of spaces may similarly have projection placed along the angle along the line adjoining each of the projections. Similarly, a third column of spaces may also have projection placed along the angle along the line adjoining each of the projections. The projections along each column may not only be offset relative to one another, but also off set relative to the projections in an adjacent column as well. Moreover, even with the projections extending within each respective space, a portion of the space may be free of the projection.

Other variations may, of course, utilize alternative arrangements of the spaces and alternative number of spaces as well. Furthermore, the angle may range in different values depending upon a number of parameters such as the number of spaces, size and positioning of the projections, etc.

With the index plate positioned vertically relative to the containers, each of the trigger release arms extending from each of the containers may extend at least partially into or through each respective space. The first actuator may translate the index plate via rotational engagement of the selector gear to the gear rack for moving the index plate in a first direction of translation over the width of the housing. While the index plate is translated along the first direction, the plate may be maintained at a position relative to each of the trigger release arms so that the trigger release arms are situated below each of the projections to allow for unhindered translation of the index plate.

Once the index plate and selected trigger release arm are suitably aligned, the release actuator may then be activated to urge the index plate along the second direction of translation which may be transverse to the first direction such that the projection presses upon or otherwise contacts the selected trigger release arm. The actuation of the selected trigger release arm may allow for the trigger lever to rotate about its own longitudinal axis such that the distal end of the trigger lever enables the release of the locking mechanism which may then allow for the corresponding door to be opened. The rotating gear may also slide along the gear rack in the second direction so that the index plate may move without hindrance. Because of the off-set spacing of each projection relative to one another with the column and between the different columns, the alignment of the projection to a selected trigger release arm may allow for the release of only that selected trigger release arm. The remaining unselected trigger release arms may remain unactuated by the corresponding projections which remain unaligned. In the event another door is selected to be opened, the index plate may again be translated in the first direction until the corresponding projection of the index plate has been aligned with the corresponding trigger release arm of the selected container.

When a selected trigger release arm is actuated, the trigger lever may rotate about its longitudinal axis to release a locking mechanism so that the corresponding door to the container may be opened. A trigger lever may be actuated such that the trigger lever may rotate about its longitudinal axis within one or more trigger lever supports. Rotation of the trigger lever may urge a distally located locking arm portion of the lever which is angled relative to the lever, e.g., transversely, to move away from the side of the container such that a latch extending from the door is released by the locking arm. With the latch disengaged and free to slide through a receiving channel, the door may be opened.

Once the door has been opened, the index plate may be translated to release the trigger lever am so that the locking arm returns to its locked configuration. After the contents of the container have been accessed, the door may be shut such that the latch reengages the locking arm to again lock the door.

An optional sensor, e.g., optical detector, may be positioned in proximity to one or more doors to indicate to the controller or processor that the corresponding door is in an open configuration. For instance, sensor grids may be positioned around the array of containers at locations which correspond to each container (or at least one container) release mechanism. Each row or column of the container matrix may have a corresponding sensor grid extending along the corresponding row or column and at least one interconnecting bus or connector, e.g., drawer open detector and interconnect PCB, may extend along the length or width of the bin matrix for connection to each of the sensor grids. Each of the sensor grids may be electrically coupled to the interconnecting bus or connector which in turn may be electrically coupled or in electrical communication with the controller or processor.

One variation of a locking mechanism which is configured to rotate upon a pivot for engagement with a locking pin extending from the door may be used to lock and unlock the selected container. The locking mechanism may define a locking arm depression which may receive the locking arm which abuts a shoulder when in the locked configuration. The contact between the locking arm and shoulder may prevent the locking mechanism from rotating thereby retaining the locking pin within a pin receiving channel. Once the lever arm has been actuated and the locking arm lifts, the locking arm may become disengaged from the shoulder allowing for the locking mechanism rotate about the pivot to the release locking pin from the pin receiving channel. A biasing member, e.g., spring element, may be incorporated with the locking mechanism to maintain the mechanism in either an engaged or disengaged state when the locking arm is released.

Other locking mechanisms may be utilized in alternative variations and are intended to be within the scope of this disclosure. Alternatively and/or additionally, different containers may incorporate different locking mechanisms within the same cabinet or the locking mechanisms may be omitted entirely from certain containers if so desired.

In yet another variation, a single index plate may be utilized for actuating a single cabinet assembly having a first assembly of containers and a second assembly of containers positioned on an opposite side of the first assembly of containers. In this variation, the single index plate may be configured to engage each of the trigger release arms from both the first and second assemblies from both sides of the index plate.

In yet a further variation, another cabinet assembly may utilize two (or more) separate index plates positioned adjacent to one another may allow for the translation of one or both plates to efficiently actuate individual containers. Additional index plates may be utilized in other alternative variations, for example, three or more index plates positioned adjacent to one another, if so desired.

In yet another variation, individual trays or drawers may be utilized instead of a lockable door. These trays or drawers may be configured to slide out or be removed entirely from the housing where the locking mechanisms for securing the trays or drawers may comprise any of the locking mechanisms described herein.

In yet another variation, the index plate and locking mechanisms may be used to control the opening of one or more drawers rather than individual latches, e.g., for use in a tabletop cabinet or drawer zone, etc.

In yet another variation, the trays or drawers may be replaced with a series of packages arranged on a surface with each package retained by one or more hooks which may be selectively released using any of the mechanisms described herein. These packages may be optionally arranged to drop into a receptacle or chute for delivery to another location Examples and details of cabinets which utilize various index plate embodiments as well as various locking and tracking features are further described in U.S. patent application Ser. No. 14/659,209 filed Mar. 16, 2015 and which is incorporated herein by reference in its entirety and for any purpose. These various embodiments and features may be utilized in any number of combinations with any of the features described herein.

With the use of the devices and methods described herein, use of the actuators in the manner described may save on parts and assembly costs as the assemblies described may utilize fewer components than conventional systems. Moreover, the number of bins may be scaled to any number for use with the index plate assemblies.

These variations and any of the different features described herein are intended to be utilized in any number of combinations with the different index plate variations. While specific combinations described herein are intended to be illustrative, other various combinations are expressly intended to be within the scope of this disclosure.

DETAILED DESCRIPTION OF THE INVENTION

Figure 1A:
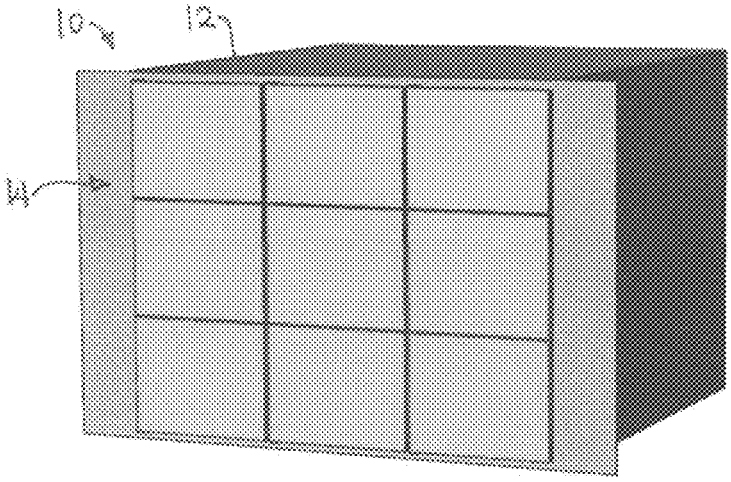
FIGS. 1A to 1C show perspective views of one example of a dispensing cabinet which may incorporate the various devices and methods described.

The mechanisms described for controlling access to one or more storage containers may be incorporated in any number of dispensing cabinets that are generally utilized in facilities where the automated tracking and dispensation of supplies is tightly controlled or regulated. An example of a typical dispensing cabinet is shown in the perspective view of FIGS. 1A to 1C which illustrate a cabinet 10 enclosed by a housing 12 which contains one or more individual storage containers 14 which are arranged in a vertically stacked configuration such that access is provided by doors which may be opened along a side of the cabinet 10.

Any one of these storage containers 14 may be controlled to individually lock or unlock selected containers 14 in an efficient manner. Such cabinets 10 may optionally incorporate a user interface such as a touchscreen as well as a keyboard or other user input device which is in communication with a processor 51. Additionally, an automated identification interface, e.g., magnetic card reader, bar code reader, fingerprint reader (or other biometric identification device), etc., may also be optionally incorporated and in communication with the processor 51.

Figure 1B:
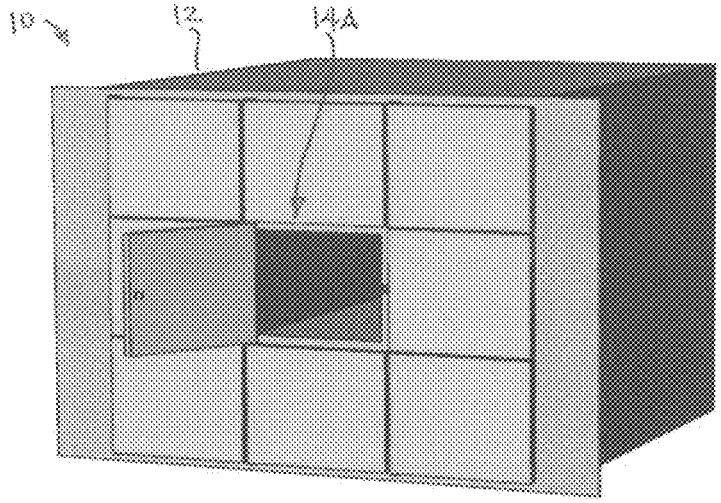
Figure 1C:
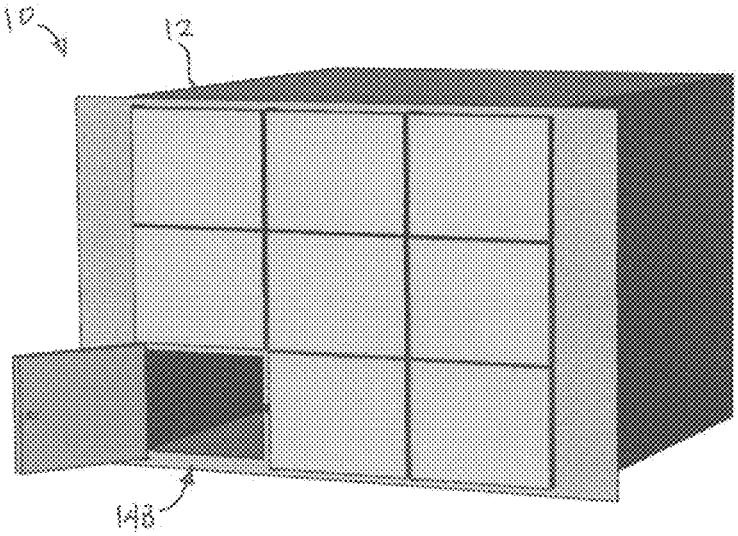

FIGS. 1B and 1C illustrate how a first storage container 14A may be selectively unlocked to allow access to this individual container 14A while the other containers remain locked and a second storage container 14B may be unlocked as well while the first container 14A is locked. While a 3×3 array of vertically arranged containers 14 is shown in this example, this is intended to be illustrative and other cabinet configurations may be utilized in various different array configurations as well. Moreover, each of the individual doors is shown as opening in a sideways direction relative to the cabinet 10. In other variations, the doors may be configured to open in any number of directions, e.g., an opposing direction, upwards, downwards, or the doors may be removed entirely from the cabinet 10 when unlocked.

Additionally and/or optionally, each of the containers 14 or a select number of containers may incorporate one or more sensors, as known in the art, which may communicate with the processor to sense, detect, and/or track which drawers, doors, or lids are being accessed by the user.

When in use, a user may for instance enter their identification or some other entry code or feature (e.g., password, passcode, RFID, NFC, etc.) through a user interface in communication with the processor. Once the user gains electronic entry to the system, one or more particular items in a corresponding container 14 may be unlocked to provide access to the previously locked item and access may be provided to the user only to one or more individual containers 14 by unlocking only those individual containers while maintaining the remaining containers in a locked state to restrict their access.

The unlocking of selected individual containers 14 may be accomplished by one or more selector index plate assemblies which may effectively and efficiently seek and unlock a selected container 14, as described in further herein. The use of a selector plate assembly and variations of the plate assembly may be utilized in any number of storage applications where the release of the stored contents is to be controlled. One example is shown in the cross-sectional top view of cabinet 10 of FIG. 2A and the corresponding cross-sectional side view of cabinet 10 of FIG. 2B.

Figure 2A:
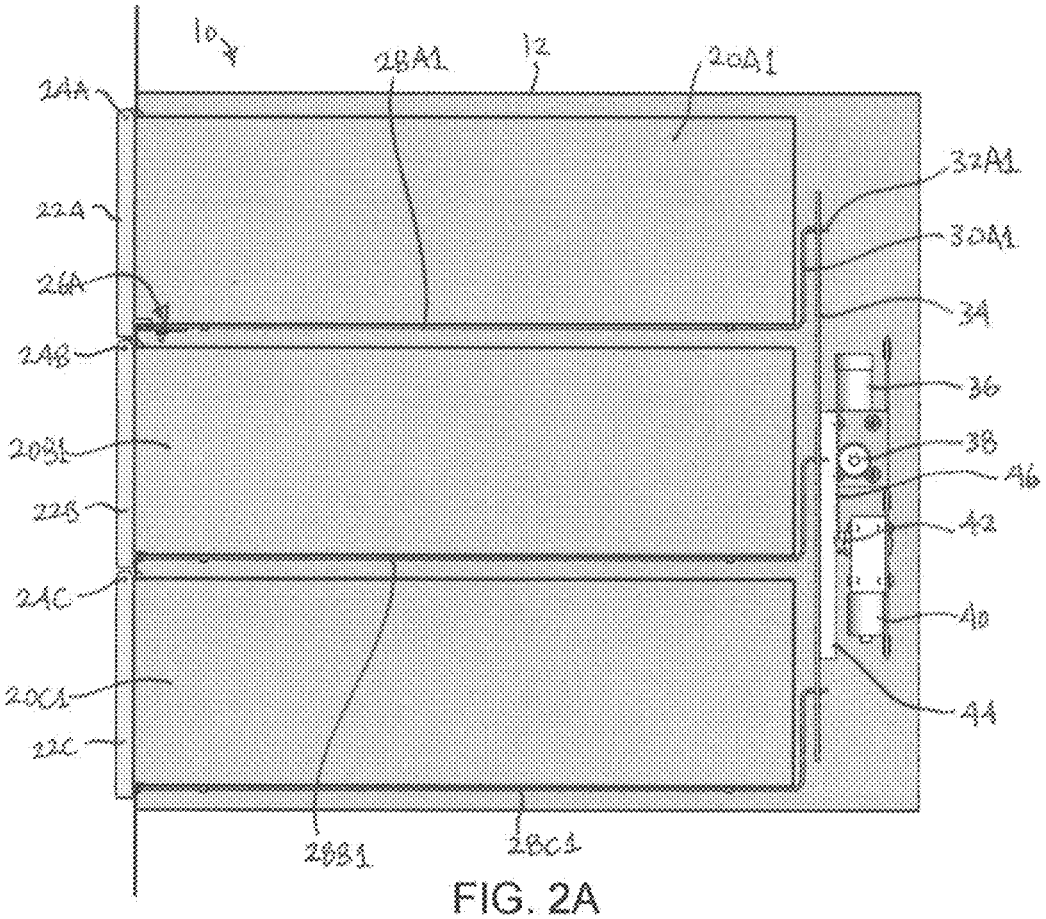
FIGS. 2A and 2B show partial cross-sectional top and side views of the cabinet interior illustrating the positioning of the index plate relative to the containers.
Figure 2B:
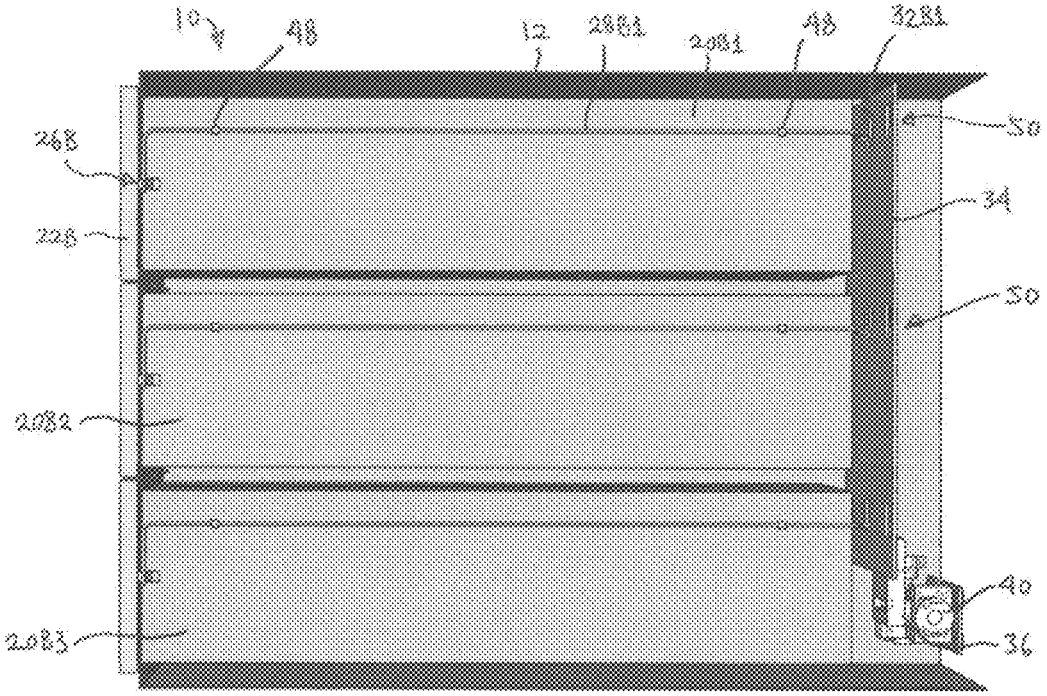

As illustrated in this variation, the individual storage containers are shown in FIG. 2A arranged side-by-side with storage containers 20A1, 20B1, 20C1 located within a first plane while FIG. 2B illustrates how the individual containers are further arranged in a stacked vertical configuration with storage containers 20B1, 20B2, 20B3. As previously mentioned, this arrangement is intended to be illustrative and other container configurations may be utilized in alternative embodiments.

Each of the individual containers may have a locking door 22A, 22B, 22C each pivotably coupled to the housing 12 via a corresponding hinge 24A, 24B, 24C. While each of the containers may incorporate its own locking mechanism 26A, reference is made to the first container 20A1 for illustrative purposes. Moreover, each of the containers may also incorporate a trigger lever which extends from the locking mechanism 26A and to an index plate 34 positioned proximally of the containers. As shown, the trigger lever may comprise an elongate member or structure such as a tubular-shaped member which is positioned along an outer surface of each container while held against the outer surface via one or more trigger lever supports 48 which hold the trigger lever while also allowing the lever to rotate about its longitudinal axis when actuated. Each container may be seen with a corresponding trigger lever 28A, 28B, 28C each of which extends along the container proximally towards the index plate 34.

With reference to trigger lever 28A1, the proximal end of the trigger lever may be configured to bend or curve to form a transverse arm 30A1 which extends at an angle, e.g., 90 degrees, relative to a longitudinal axis of the lever 28A1. The proximal end of the transverse arm 30A1 may bend or curve again, e.g., 90 degrees, relative to the transverse arm 30A1 to form a trigger release arm 32A1 which may project in parallel to the lever 28A1. It is the trigger release arm 32A1 which may interface and engage with the index plate 34 for actuating the trigger lever 28A1 (described in further detail herein). The index plate 34 may form transverse arm receiving spaces 50 over the plate 34 which correspond to each trigger lever extending from each respective container.

The index plate 34 may comprise a flat plate having a width and a height which is sized to extend along the width and height of the array of containers such that the index plate 34 is positioned proximally of the containers. Such an index plate 34 may be fabricated from any number of materials, e.g., steel, plastic, aluminum, wood, composites, etc. The index plate 34 may be positioned such that the plate 34 extends vertically while parallel with the containers although the index plate 34 may be angled relative to the containers if so desired. An interface plate 44 may be formed as part of the index plate 34 or attached as a separate portion in proximity to one or more actuators which are used to translate and position the index plate 34 relative to the containers.

Figure 2C:
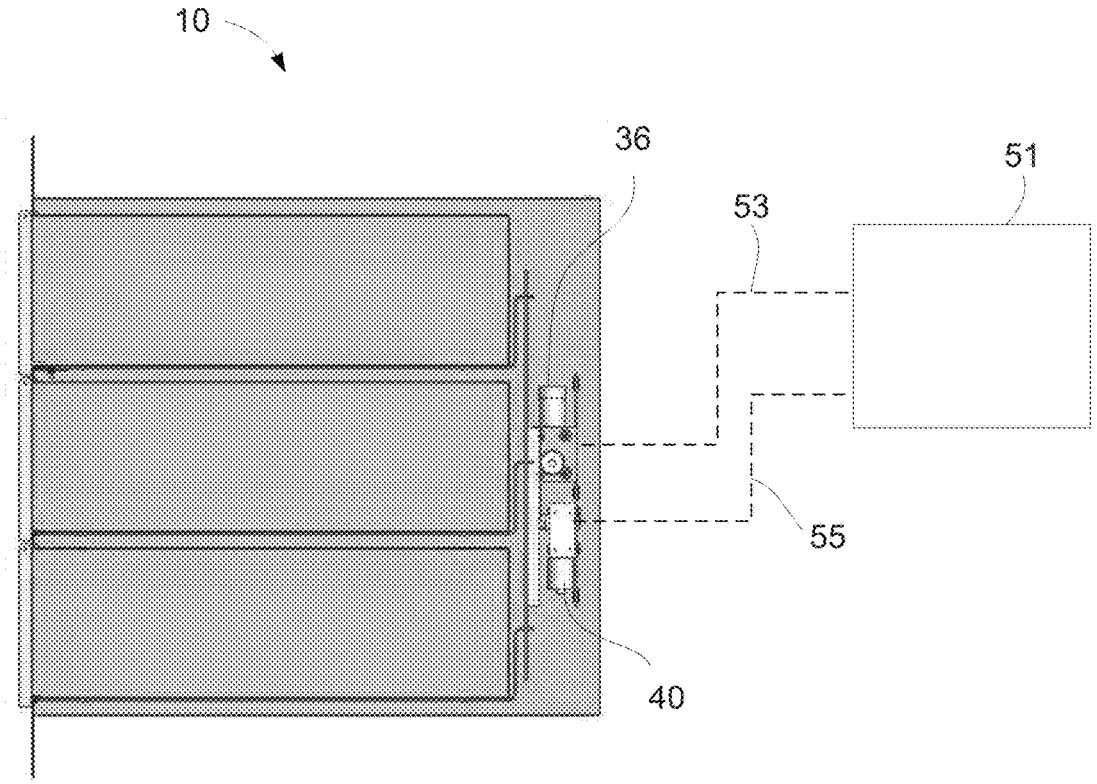
FIG. 2C shows a schematic top view of the actuators in wired or wireless communication with a controller or processor.

A first actuator 36 (e.g., selector motor and encoder) may be mounted or secured relative to the housing 12 and may have a selector gear 38 attached for engagement with a gear rack 46 positioned upon the interface plate 44 or the index plate 34 itself. The selector gear 38 may be rotatably coupled to the first actuator 36 and the gear rack 46 may be positioned near or at an edge of the index plate 34 such that the gear rack 46 extends at least partially along the width of the index plate 34. A second actuator 40 may also be mounted or secured relative to the housing 12 to function as a release actuator and may have a cam 42 attached also for engagement with the interface plate 44. Additionally, one or both of the actuators may be in communication with a controller or processor for controlling the positioning of the index plate 34 when actuated. As shown in the schematic illustration of FIG. 2C, the controller or processor 51 (which may be locally or remotely located from cabinet 10) may be in communication with each respective actuator. For instance, controller or processor 51 may be in wired or wireless communication 53 with first actuator 36 and may also be in wired or wireless communication 55 with second actuator 40, as shown.

Figure 2D:
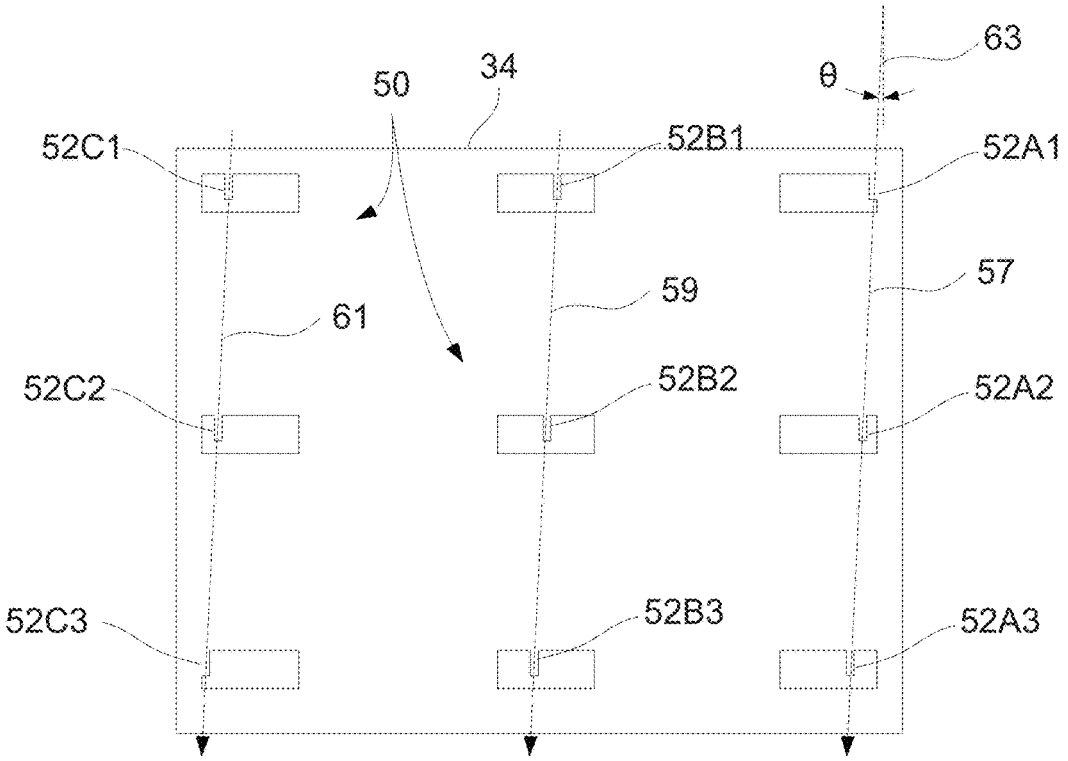
FIG. 2D shows a view of one variation of the index plate illustrating the relative positioning of the projections.

With respect to the index plate 34, FIG. 2D shows a view of the plate having a number of spaces 50 which correspond to the number of containers 14. The positioning of the spaces 50 may also correspond to the proximal position of the containers 14. Generally, each of the spaces 50 are large enough so that translation of the plate 34 allows for the unhindered movement of the plate 34 relative to each of the trigger release arms which extend through each of the spaces 50. As illustrated, each of the transverse arm receiving spaces 50 comprises a projection or shoulder which extends within the space 50 at a preselected position. For instance, the first column of spaces 50 over the index plate 34 shows projections 52A1, 52A2, 52A3 which extend within each space and off set relative to one another. The positioning of the projections 52A1, 52A2, 52A3 may be placed along an angle θ defined between the vertical axis 63 of the index plate 34 and the line 57 adjoining each of the projections 52A1, 52A2, 52A3 within the first column of spaces 50. The second column of spaces 50 may similarly have projection 52B1, 52B2, 52B3 placed along the angle θ along the line 59 adjoining each of the projections 52B1, 52B2, 52B3. Similarly, the third column of spaces 50 may also have projection 53C1, 53C2, 53C3 placed along the angle θ along the line 61 adjoining each of the projections 53C1, 53C2, 53C3. The projections along each column may not only be offset relative to one another, but also off set relative to the projections in an adjacent column as well. Moreover, even with the projections extending within each respective space 50, a portion of the space 50 may be free of the projection as shown.

While the index plate 34 in FIG. 2D shows an array of 3×3, this is intended to be illustrative of one variation. Other variations may, of course, utilize alternative arrangements of the spaces and alternative number of spaces as well. Furthermore, the angle θ may range in different values depending upon a number of parameters such as the number of spaces, size and positioning of the projections, etc.

As shown in the perspective views of FIGS. 3A to 3D of the rear of cabinet 10 (housing 12 is partially removed for illustrative purposes), the index plate 34 may be seen positioned vertically relative to each of the containers. With the index plate 34 so positioned, each of the trigger release arms extending from each of the containers may extend at least partially into or through each respective space 50. The first actuator 36 may be seen translating the index plate 34 via rotational engagement of selector gear 38 to gear rack 46 for moving the index plate 34 in a first direction of translation 54 over the width of the housing 12. While the index plate 34 is translated along the first direction 54, the plate 34 may be maintained at a position relative to each of the trigger release arms so that the trigger release arms are situated below each of the projections to allow for unhindered translation of the index plate 34.

Figure 3A:
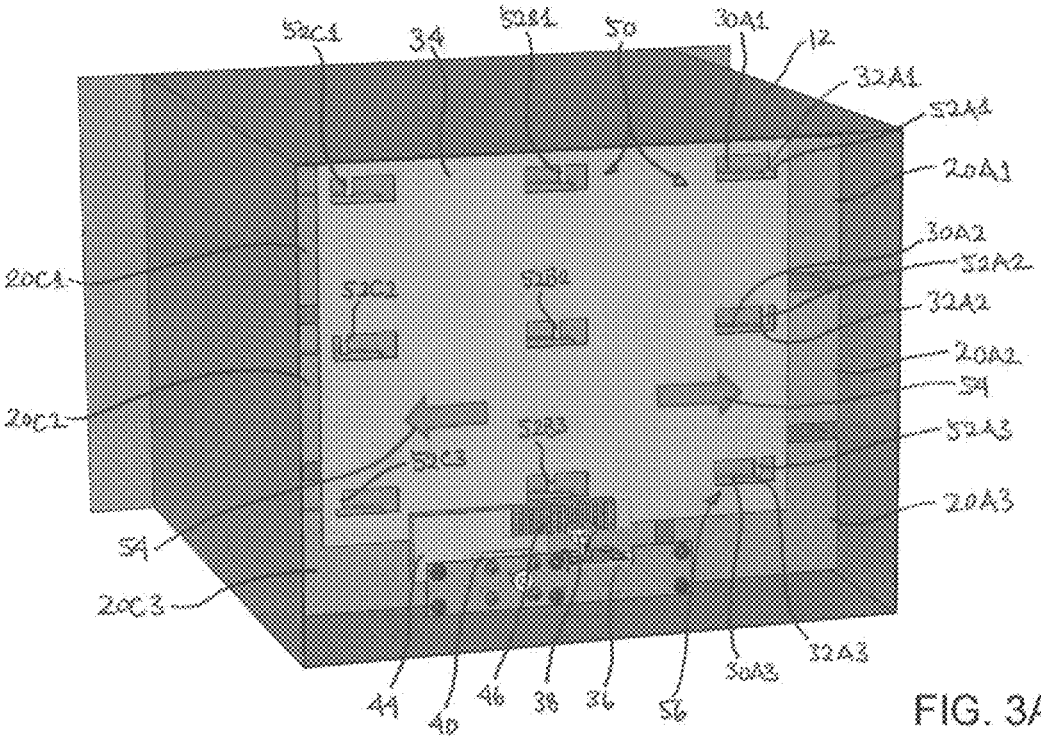
FIGS. 3A and 3B show perspective views of one example of the index plate being translated in a first direction and a second direction to open a selected container.
Figure 3B:
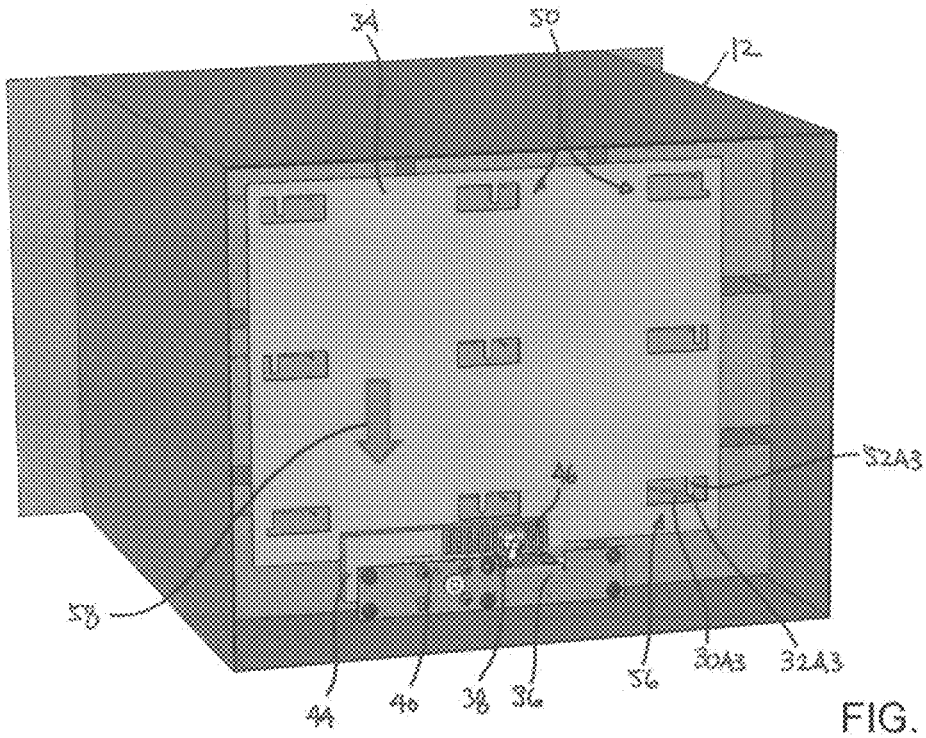

In this illustration, the index plate 34 may be used to open a selected container 20A3 by actuating the preselected trigger release arm 56. The index plate 34 may be accordingly translated along direction 54 by the actuator 36 rotating gear 38 via gear rack 46 until the projection 52A3 is aligned above the selected trigger release arm 32A3. Once suitably aligned, the release actuator 40 may then be activated to urge the index plate 34 along the second direction of translation 58 which may be transverse to the first direction 54 such that the projection 52A3 presses upon or otherwise contacts the selected trigger release arm 32A3, as shown in FIG. 3B. The actuation of the selected trigger release arm 32A3 may allow for the trigger lever to rotate about its own longitudinal axis such that the distal end of the trigger lever enables the release of the locking mechanism which may then allow for the corresponding door to be opened. The rotating gear 38 may also slide along the gear rack 46 in the second direction 58 so that the index plate 34 may move without hindrance. Because of the off-set spacing of each projection relative to one another with the column and between the different columns, the alignment of the projection to a selected trigger release arm may allow for the release of only that selected trigger release arm. The remaining unselected trigger release arms may remain unactuated by the corresponding projections which remain unaligned.

Figure 3C:
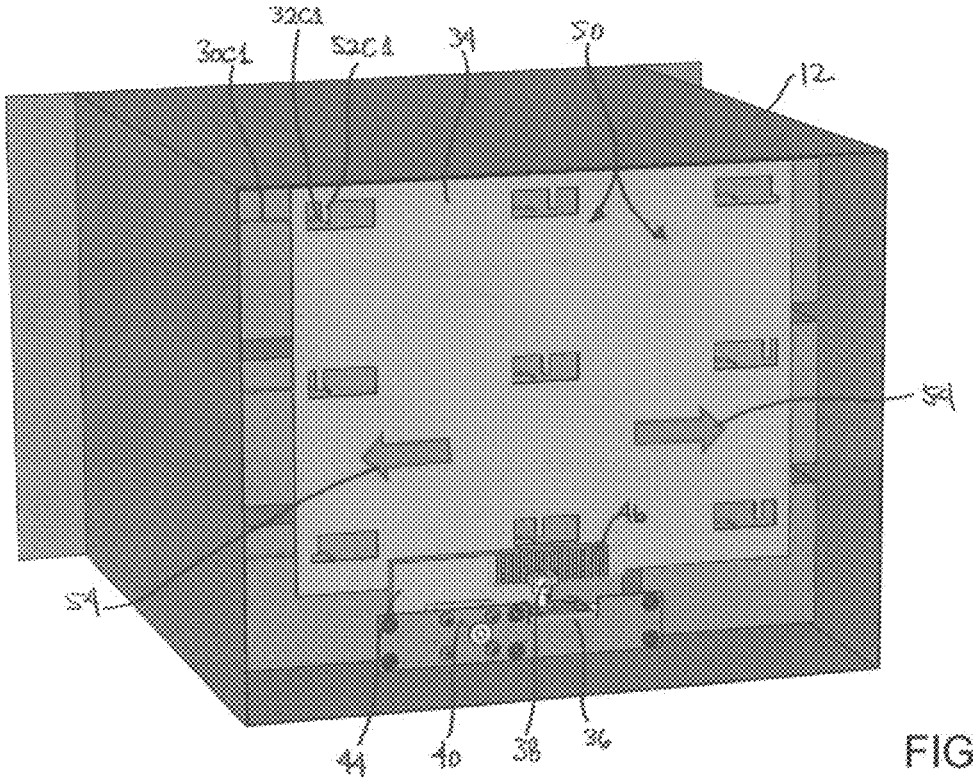
FIGS. 3C and 3D show perspective views of another example of how the index plate may be further translated to open a second selected container.
Figure 3D:
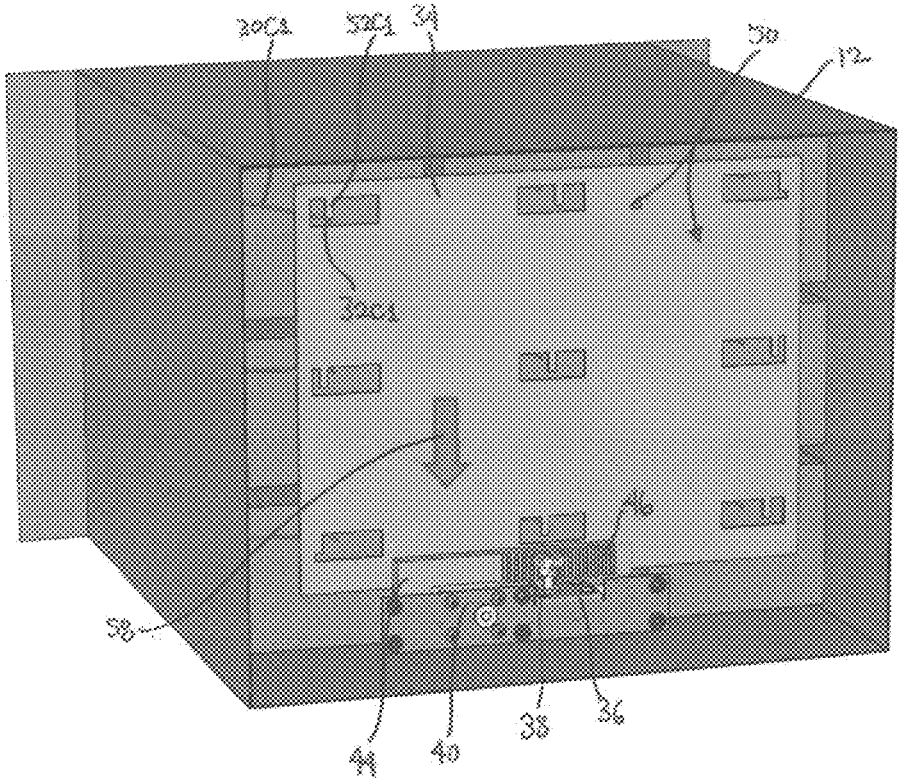

In the event another door is selected to be opened, the index plate 34 may again be translated in the first direction 54 until the corresponding projection of the index plate 34 has been aligned with the corresponding trigger release arm of the selected container. FIG. 3C shows the further example where the index plate 34 is further translated in the first direction 54 until the projection 52C1 has been aligned with the trigger release arm 32C1 of trigger lever 30C1. As described above, the first actuator 36 may rotate the gear 38 to engage the gear track 46 to translate the index plate 34 accordingly. Once the projection 52C1 has been aligned with the trigger release arm 32C 1, the index plate 34 may then be translated in the second direction 58 by actuating release actuator 40 until the trigger release arm 32C1 has been contacted by the projection 52C1 to actuate the lever arm to allow for the opening of the corresponding door, as shown in FIG. 3D.

Figure 4A:
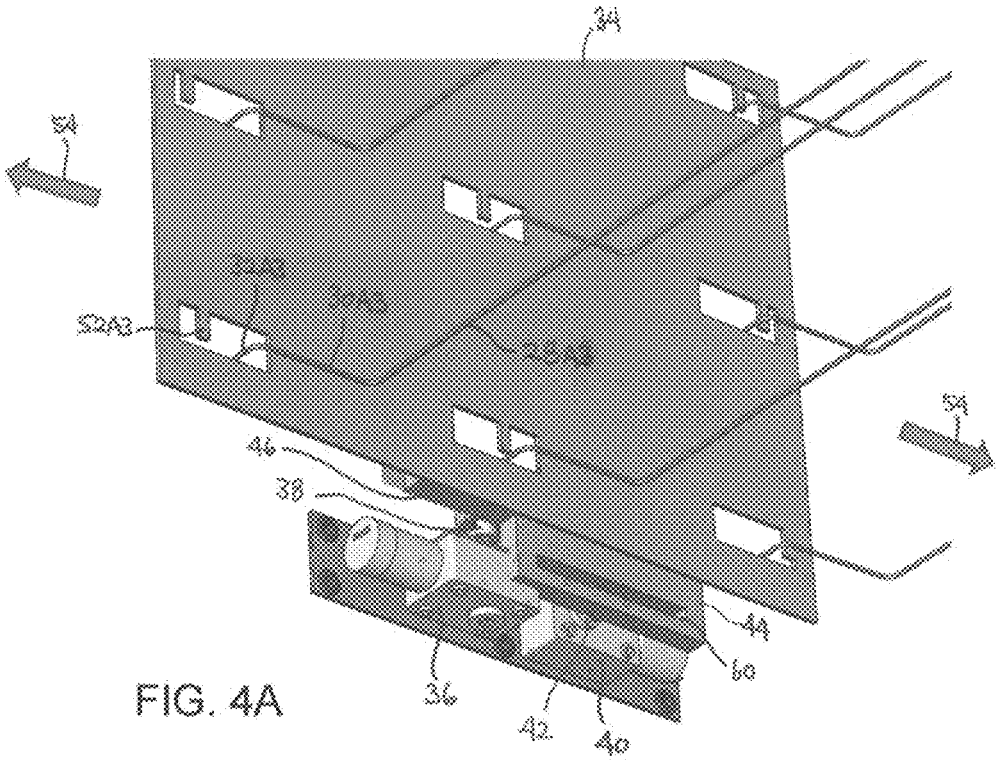
FIGS. 4A to 4C show perspective rear views of the index plate interacting with the trigger release arms.
Figure 4B:
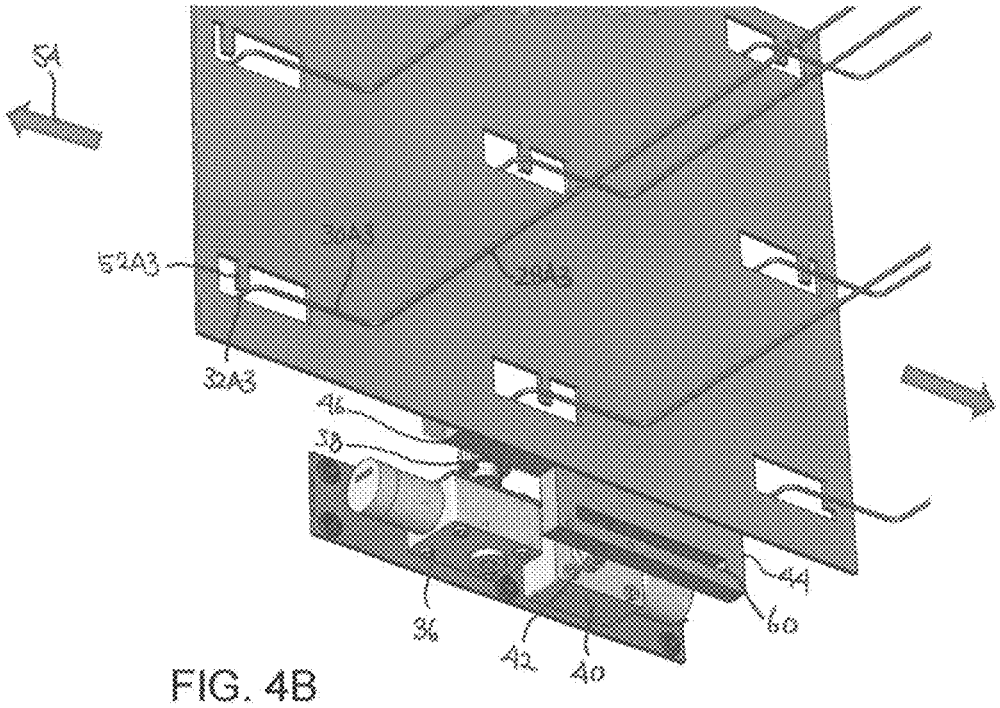
Figure 4C:
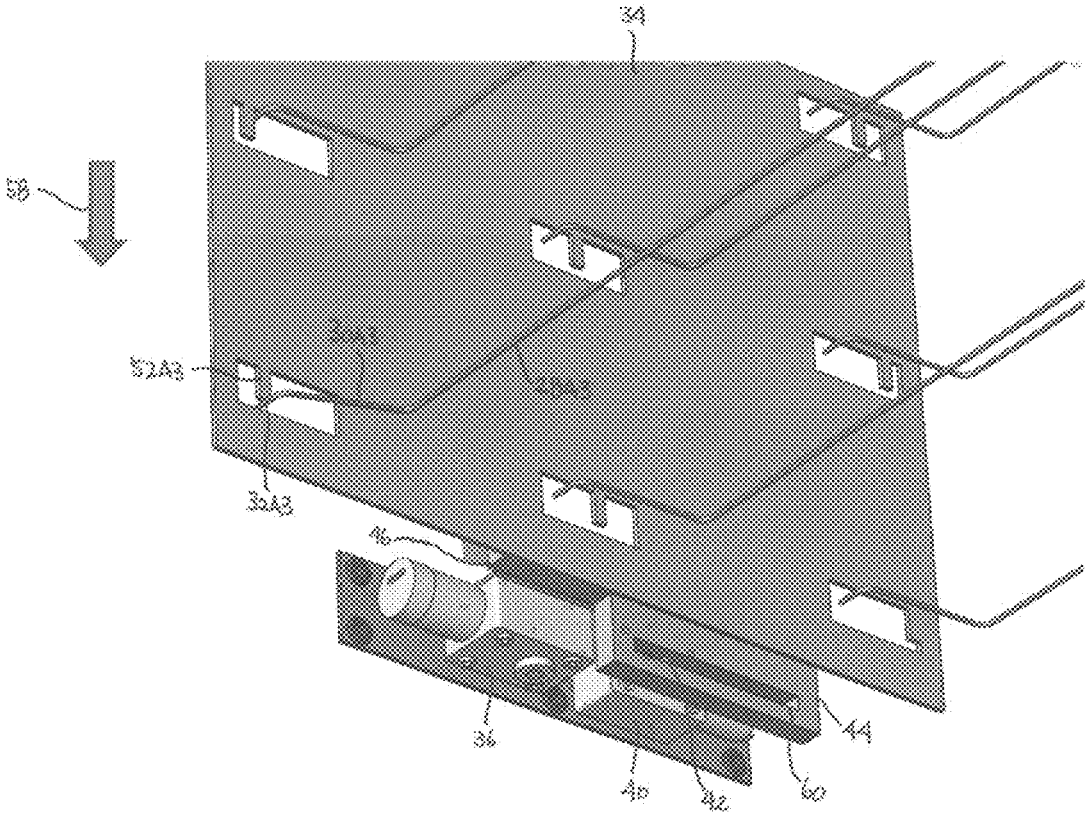

FIG. 4A shows a reversed perspective view of the index plate 34 with the containers and housing removed for clarity. As shown, the index plate 34 may be translated in the first direction 54 to align the projection 52A3 with the trigger release arm 32A3 by actuation of the first actuator 36. FIG. 4B shows a view of when the projection 52A3 has been aligned just above trigger release arm 32A3. As the index plate 34 translate, each of the trigger release arms may remain clear of the projections due to the space below each of the projections. The cam 42 of the second actuator 40 may travel within the guide channel 60 defined through interface plate 44 so that the second actuator 40 does not inhibit movement of the index plate 34. The second actuator 40 may be actuated to engage the sides of guide channel 60 so as to move the index plate 34 along the second direction 58 to contact the end of the projection 52A3 against the trigger release arm 32A3, as seen in FIG. 4C. As the cam 42 is rotated, e.g., a single revolution, by the second actuator 40, it may push against the side of the guide channel 60 at a predetermined distance to urge the index plate 34 a short distance in the second direction 58.

The index plate 34 may be seen translating in the second direction 58 without contacting any of the remaining trigger release arms due to the off-set positioning of each of the projections. Hence, when the index plate 34 is aligned to actuate a single preselected trigger release arm, the remaining projections are aligned in their off-set manner so that no other trigger release arm is contacted.

Figure 5A:
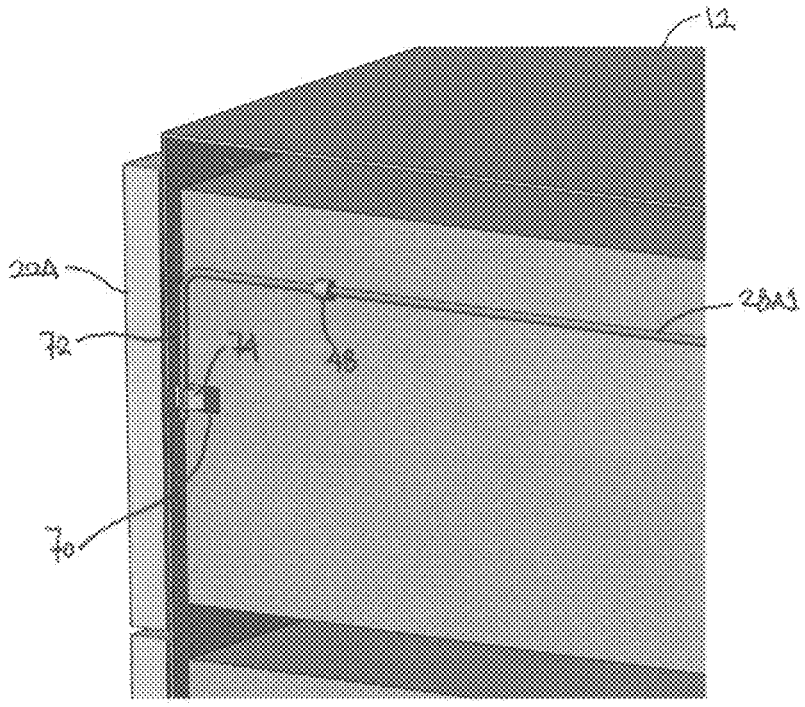
FIGS. 5A to 5D show perspective side views of one variation of how the trigger lever may be rotated to release the door for accessing the container.
Figure 5B:
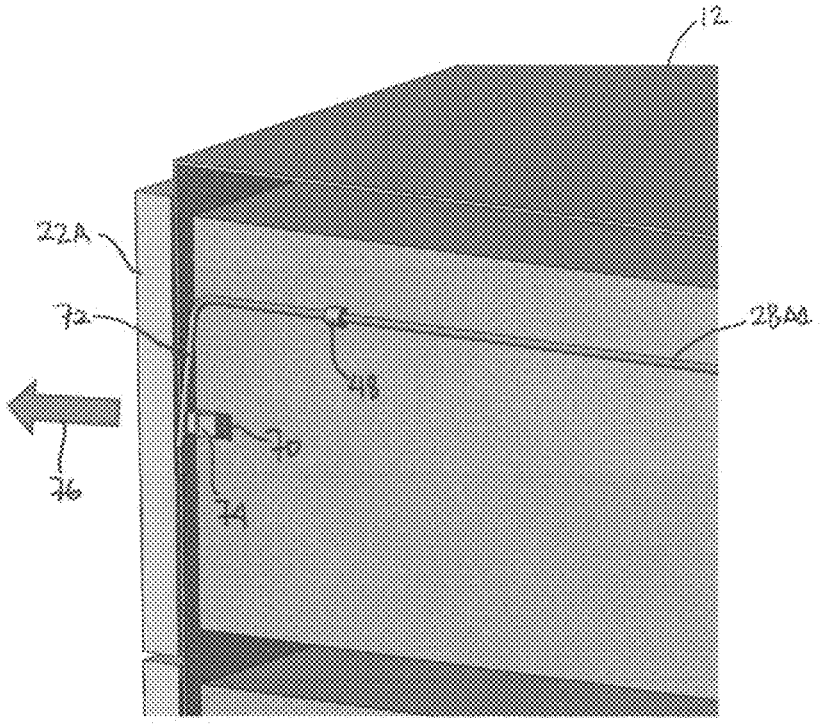
Figure 5C:
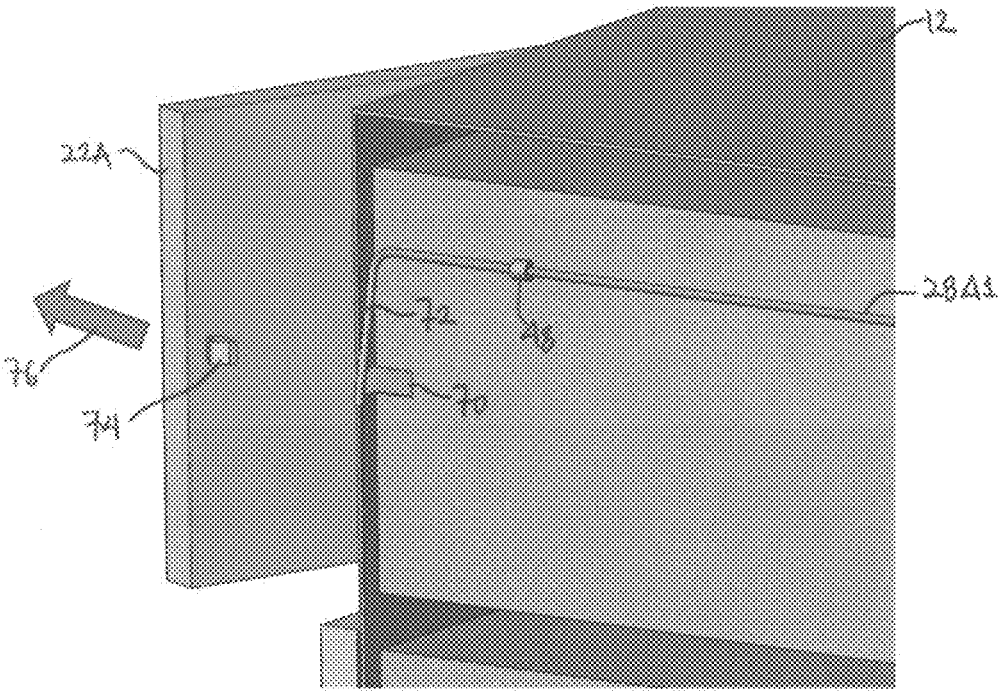

When a selected trigger release arm is actuated, the trigger lever may rotate about its longitudinal axis to release a locking mechanism so that the corresponding door to the container may be opened. FIGS. 5A and 5B illustrate detail perspective views of one container where a trigger lever 28A1 may be actuated such that the trigger lever 28A1 may rotate about its longitudinal axis within one or more trigger lever supports 48. Rotation of the trigger lever 28A1 may urge a distally located locking arm 72 portion of the lever which is angled relative to the lever 28A1, e.g., transversely, to move away from the side of the container such that a latch 74 extending from the door 22A is released by the locking arm 72, as shown in FIG. 5B. With the latch 74 disengaged and free to slide through a receiving channel 70, the door 22A may be opened as indicated by the direction of opening 76, as shown in FIG. 5C.

Figure 5D:
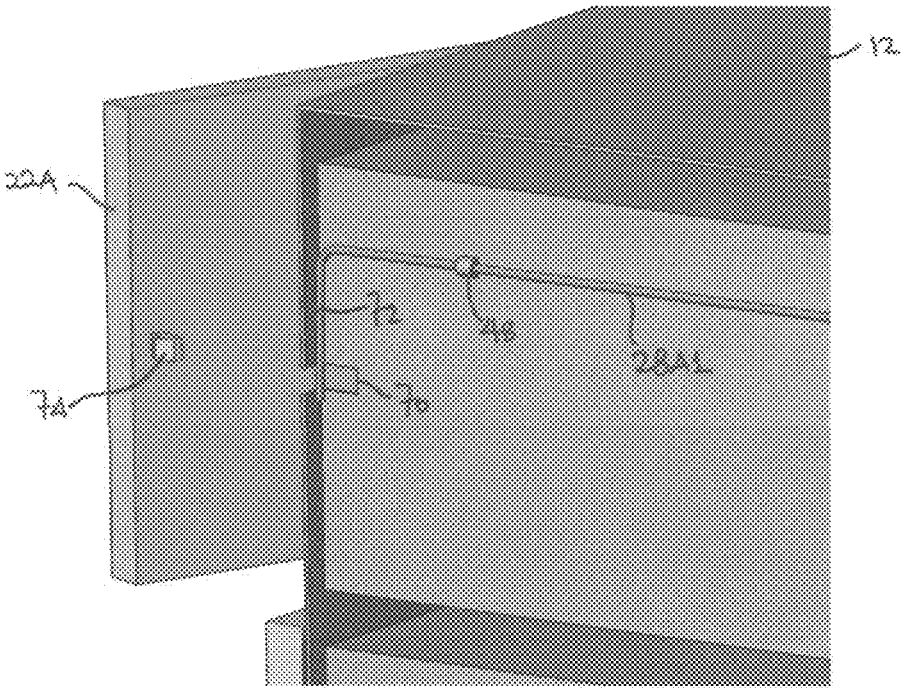
Figure 6:
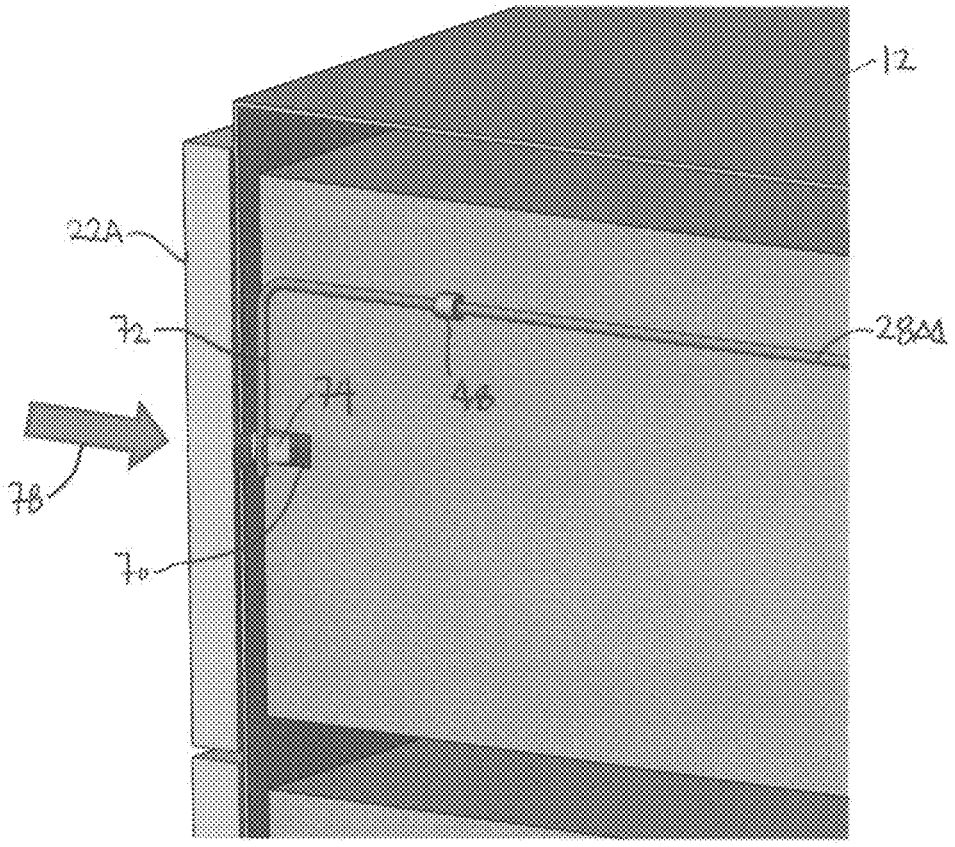
FIG. 6 shows a perspective side view of how the door may be reengaged by the trigger lever.

Once the door 22A has been opened, the index plate 34 may be translated to release the trigger lever am so that the locking arm 72 returns to its locked configuration, as shown in FIG. 5D. After the contents of the container have been accessed, the door 22A may be shut, as indicated by the direction of closing 78 in FIG. 6, such that the latch 74 reengages the locking arm 72 to again lock the door 22A.

An optional sensor, e.g., optical detector, may be positioned in proximity to one or more doors to indicate to the controller or processor 51 that the corresponding door is in an open configuration. For instance, sensor grids may be positioned around the array of containers at locations which correspond to each container (or at least one container) release mechanism. Each row or column of the container matrix may have a corresponding sensor grid extending along the corresponding row or column and at least one interconnecting bus or connector, e.g., drawer open detector and interconnect PCB, may extend along the length or width of the bin matrix for connection to each of the sensor grids. Each of the sensor grids may be electrically coupled to the interconnecting bus or connector which in turn may be electrically coupled or in electrical communication with the controller or processor 51.

Figure 7A:
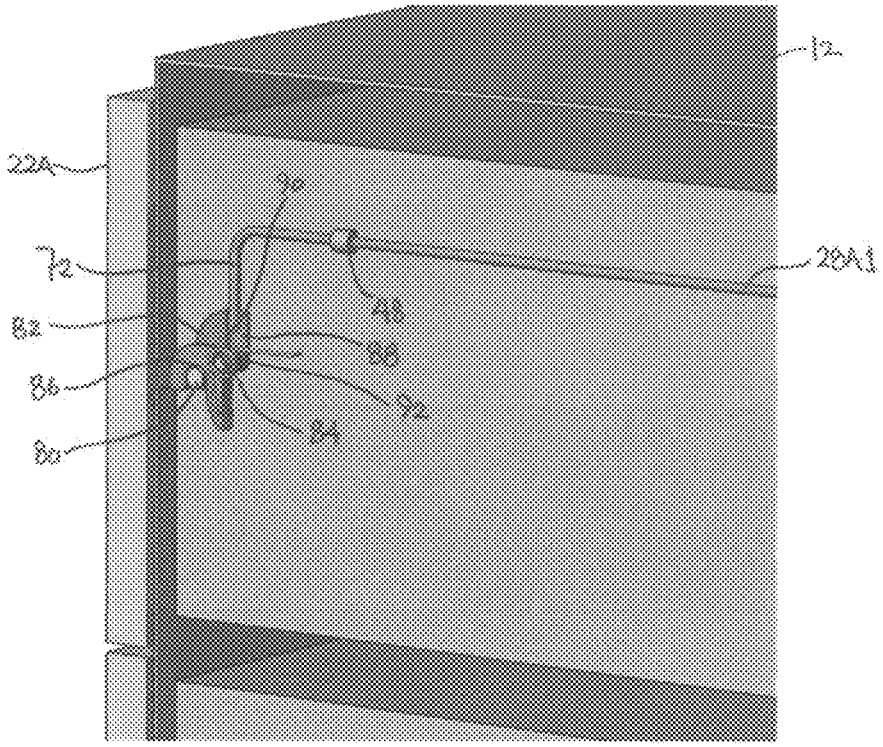
FIGS. 7A and 7B show perspective side views of another variation of a locking mechanism.
Figure 7B:
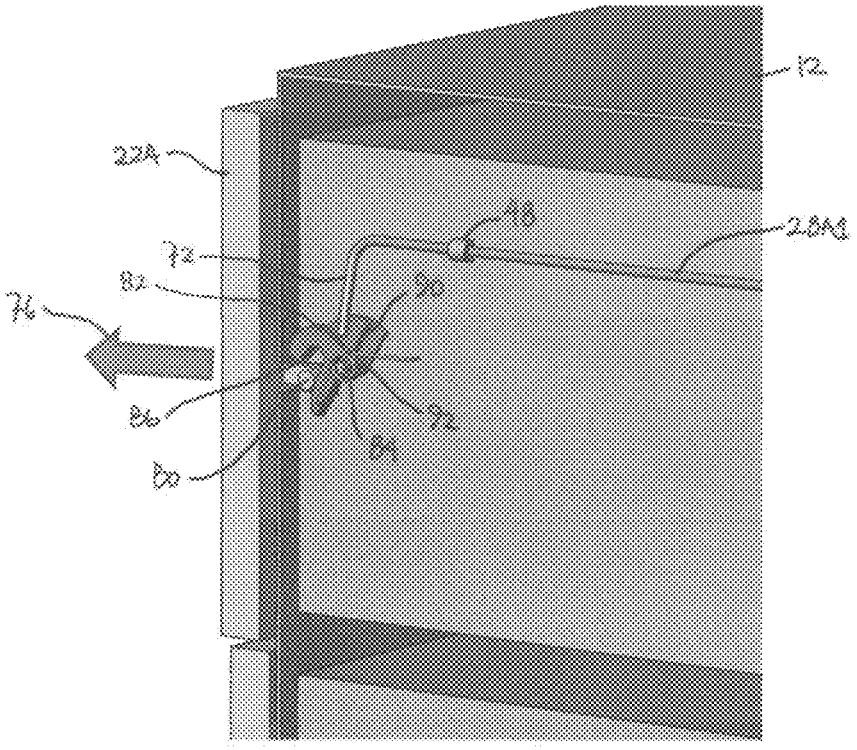

Another variation is shown in the perspective views of FIGS. 7A and 7B which illustrate a mechanism comprised generally of a locking mechanism 82 which is configured to rotate upon a pivot 84 for engagement with a locking pin 80 extending from the door 22A. The locking mechanism 82 may define a locking arm depression 88 which may receive the locking arm 72 which abuts a shoulder 90 when in the locked configuration. The contact between the locking arm 72 and shoulder 90 may prevent the locking mechanism 82 from rotating thereby retaining the locking pin 80 within a pin receiving channel 86. Once the lever arm 28A1 has been actuated and the locking arm 72 lifts, as shown in FIG. 7B, the locking arm 72 may become disengaged from the shoulder 90 allowing for the locking mechanism 82 to rotate about pivot 84 to release locking pin 80 from the pin receiving channel 86. A biasing member 92. e.g., spring element, may be incorporated with the locking mechanism 82 to maintain the mechanism 82 in either an engaged or disengaged state when the locking arm 72 is released.

Figure 8A:
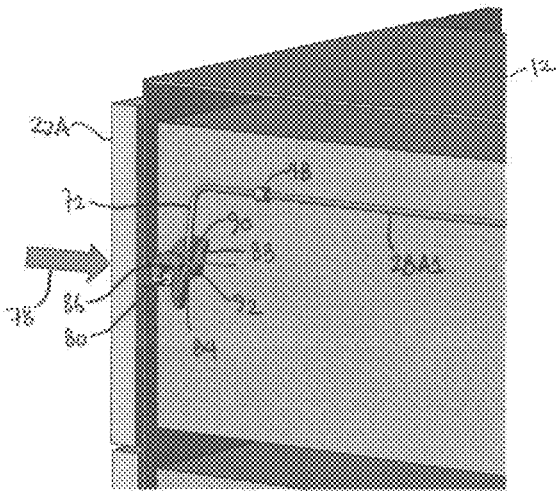
FIGS. 8A to 8C show perspective side views of how the locking mechanism of FIG. 7A may be used to reengage the door.
Figure 8B:
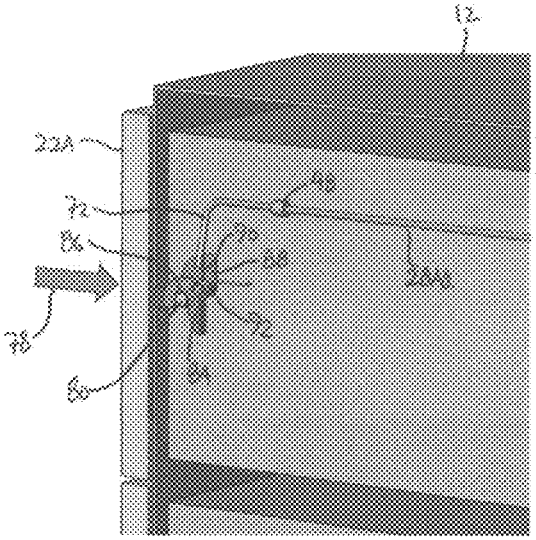
Figure 8C:
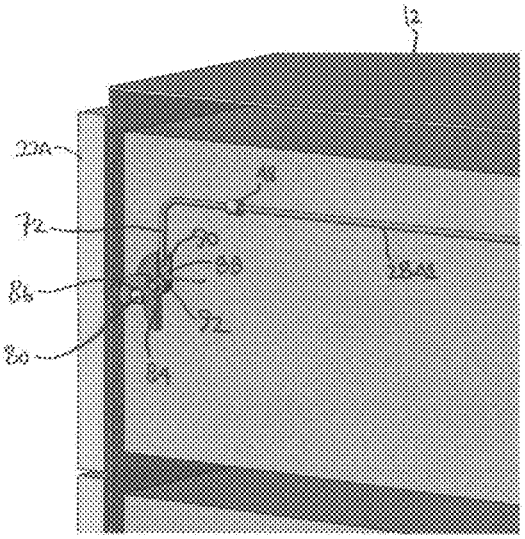

FIGS. 8A to 8C illustrate how the locking mechanism 82 may be reengaged when the door 22A is shut. As shown, if the locking mechanism 82 is maintained in its disengaged configuration by the biasing member 92, the locking pin 80 may be readily advanced within the pin receiving channel 86. Further closure of the door 22A may cause the locking pin 80 to rotate the locking mechanism 82 in the opposite direction, as shown in FIG. 8B, such that the shoulder 90 is reengaged with the locking arm 72, as shown in FIG. 8C, such that the door 22A is secured again.

Figure 9:
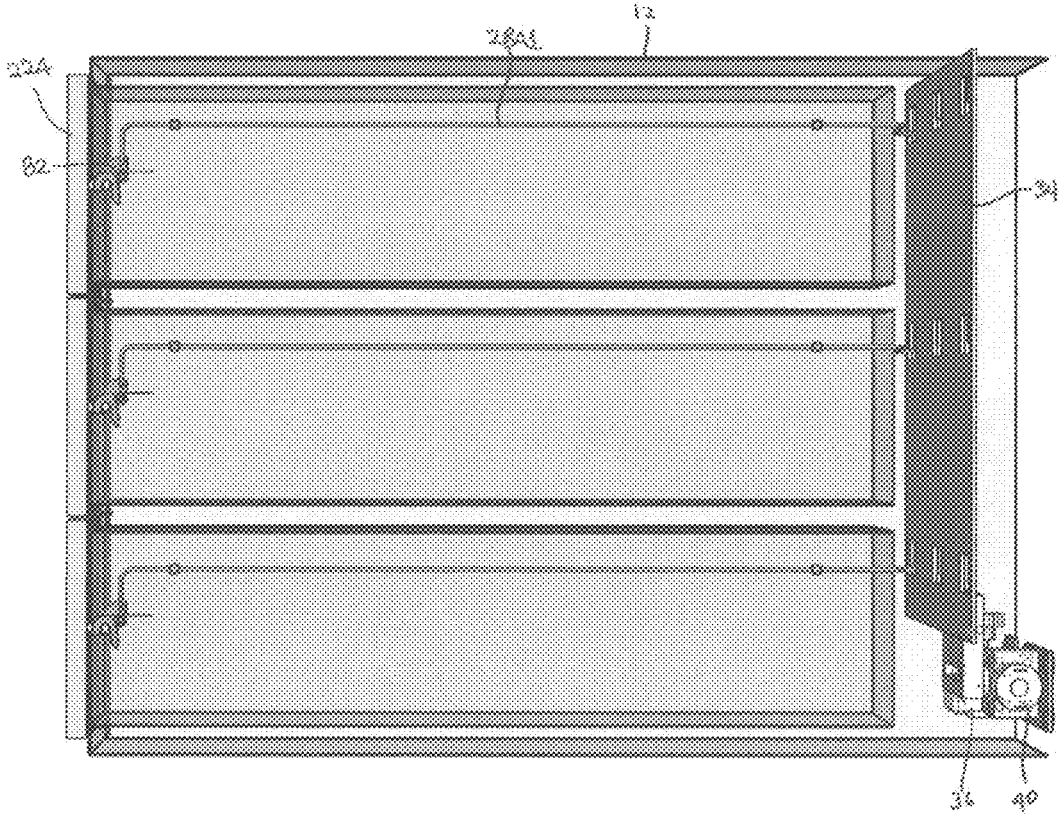
FIG. 9 shows a partial cross-sectional side view illustrating the locking mechanism of FIG. 7A incorporated with the cabinet.

FIG. 9 shows a partial cross-sectional side view of the housing 12 incorporating the locking mechanism 82 for each of the individual containers. Other locking mechanisms may be utilized in alternative variations and are intended to be within the scope of this disclosure. Alternatively and/or additionally, different containers may incorporate different locking mechanisms within the same cabinet or the locking mechanisms may be omitted entirely from certain containers if so desired.

Figure 10:
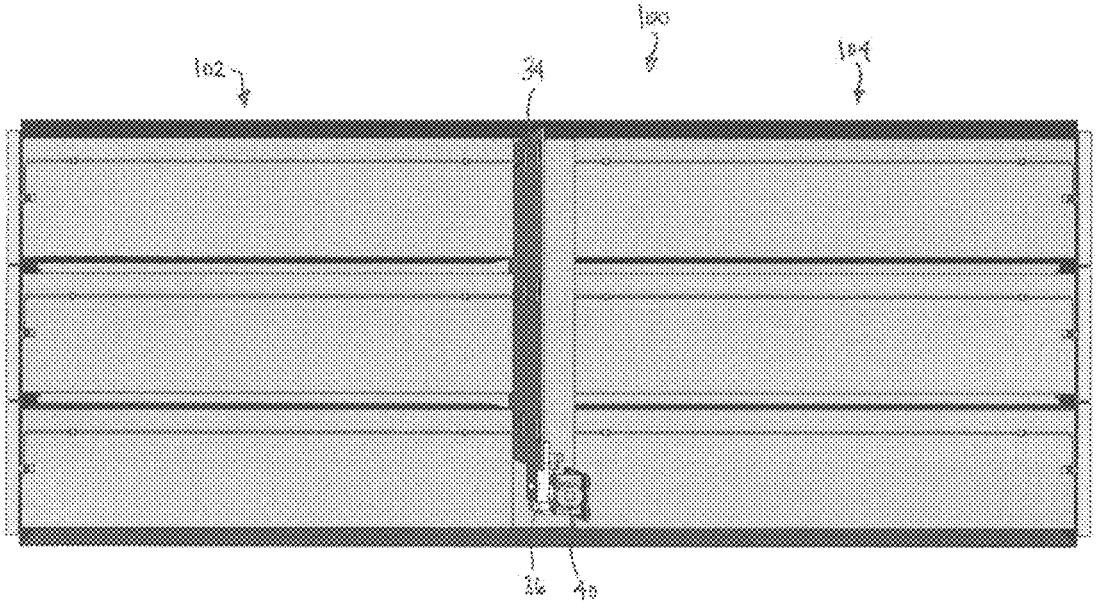
FIG. 10 shows a partial cross-sectional side view of another variation of the cabinet having a single index plate and multiple storage arrays.

In yet another variation, a single index plate 34 may be utilized for actuating a single cabinet assembly 100 having a first assembly of containers 102 and a second assembly of containers 104 positioned on an opposite side of the first assembly of containers 102, as shown in the partial cross-sectional side view of FIG. 10. In this variation, the single index plate 34 may be configured to engage each of the trigger release arms from both the first and second assemblies 102, 104 from both sides of the index plate 34.

In yet a further variation, another cabinet assembly may utilize two (or more) separate index plates positioned adjacent to one another may allow for the translation of one or both plates to efficiently actuate individual containers. Additional index plates may be utilized in other alternative variations, for example, three or more index plates positioned adjacent to one another, if so desired.

Figure 11:
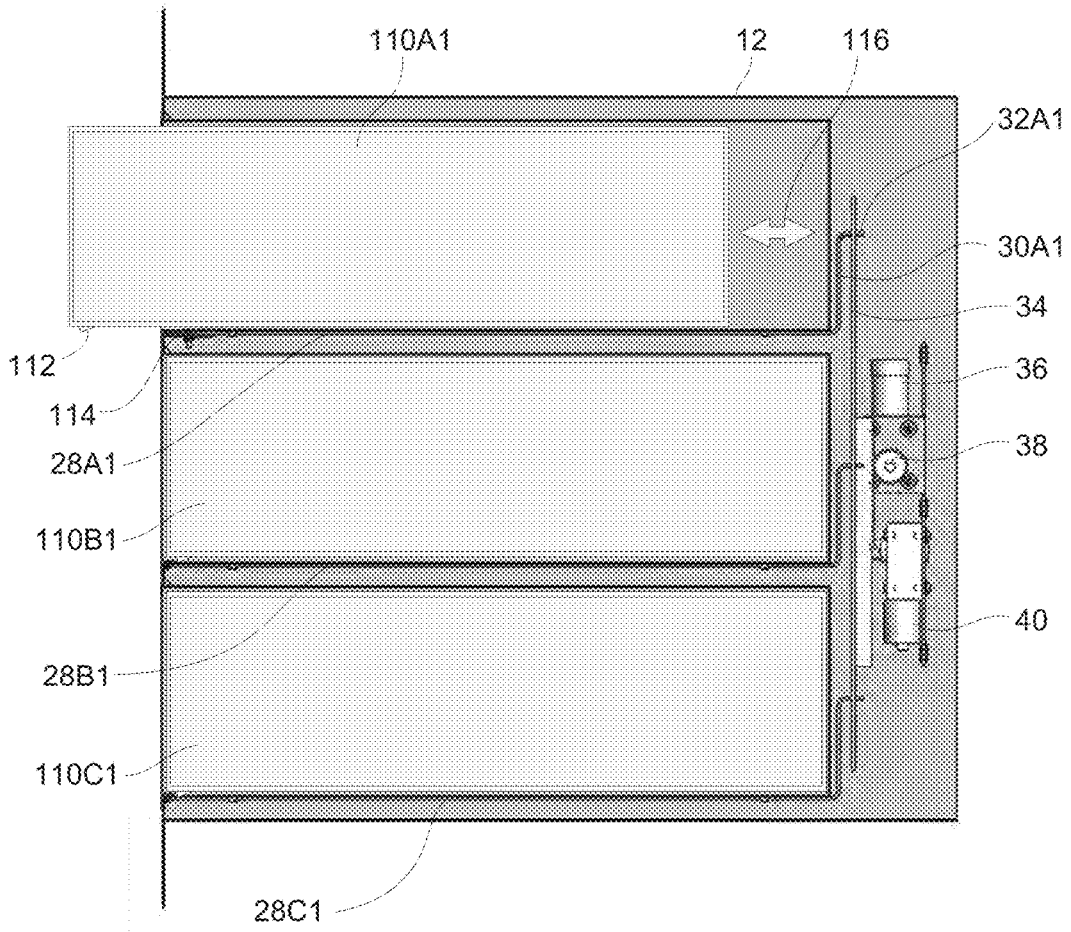
FIG. 11 shows a top view of an assembly where trays or drawers may be used in place of a lockable door.

In yet another variation, FIG. 11 shows a top view of an assembly where trays or drawers 110A1, 110B1, 110C1 may be used in place of a lockable door. The trays or drawers 110A1, 110B1, 110C1 may comprise the one or more containers and may be slidable relative to the index plate 34 such that they may slide out or be removed entirely from housing 12. In interfacing with the locking mechanism 114, a projection or latch 112 may extend or project from the side of the tray or drawer for engagement with the locking mechanism 114. The locking mechanism 114 may comprise any of the locking mechanisms described herein. Reconfiguring the trigger lever 28A1 to disengage the locking mechanism 114 from the projection or latch 112 may be accomplished by translating the index plate 34 to actuate the trigger release arm 32A1 and transverse arm 30A1, as described herein. Once the projection or latch 112 has been disengaged, the tray or drawer, e.g., 110A1, may be pulled out from the housing 12 for accessing its contents or it may be removed entirely from the housing 12. Once its contents have been accessed, the tray or drawer may be pushed back into the housing 12, as indicated by direction 116, such that the projection or latch 112 may reengage the locking mechanism 114 again.

In yet another variation, the index plate 34 and locking mechanisms may be used to control the opening of one or more drawers rather than individual latches, e.g., for use in a tabletop cabinet or drawer zone, etc.

In yet another variation, the trays or drawers may be replaced with a series of packages arranged on a surface with each package retained by one or more hooks which may be selectively released using any of the mechanisms described herein. These packages may be optionally arranged to drop into a receptacle or chute for delivery to another location.

Examples and details of cabinets which utilize various index plate embodiments as well as various locking and tracking features are further described in U.S. patent application Ser. No. 14/659,209 filed Mar. 16, 2015 and which is incorporated herein by reference in its entirety and for any purpose. These various embodiments and features may be utilized in any number of combinations with any of the features described herein.

The variations and any of the different features described herein are intended to be utilized in any number of combinations with the different index plate variations as well as with different locking mechanisms. Such combinations are expressly intended to be within the scope of this disclosure.

The applications of the devices and methods discussed above are not limited to cabinets for the controlled release of items but may include any number of further applications. Modification of the above-described assemblies and methods for carrying out the invention, combinations between different variations as practicable, and variations of aspects of the invention that are obvious to those of skill in the art are intended to be within the scope of the claims.

What is claimed is:

1. An apparatus for selective actuation, comprising:

an index plate defining one or more spaces over a surface of the plate, wherein each of the one or more spaces has a corresponding protrusion extending within such that one or more protrusions define one or more rows which are arranged upon the plate in a collinear arrangement, and wherein the one or more protrusions further define one or more columns which are arranged upon the plate at an angle such that each protrusion is off-set relative to an adjacent protrusion along the column;

a first actuator configured to translate the plate in a first direction;

a second actuator configured to translate the plate in a second direction transverse to the first direction; and one or more lever arms which correspondingly extend from a locking mechanism and the one or more spaces, wherein selective engagement of a single lever arm by a corresponding single protrusion actuates the single lever arm from a locked configuration to an unlocked configuration.

2. The apparatus of claim 1 wherein selective engagement of the single lever arm occurs without engagement of any remaining lever arms which are not selected.

3. The apparatus of claim 1 further comprising one or more containers arranged relative to one another and each having a corresponding lever arm in proximity to the index plate.

4. The apparatus of claim 3 further comprising an enclosure which the index plate and one or more containers are secured.

5. The apparatus of claim 3 wherein each of the one or more containers comprise a door which is released via actuation of the corresponding lever arm.

6. The apparatus of claim 3 wherein the one or more containers comprise one or more trays or drawers which are slidable relative to the index plate.

7. The apparatus of claim 3 further comprising a sensor in communication with each of the one or more containers.

8. The apparatus of claim 1 wherein the first actuator is engaged to the plate via a rotatable engagement.

9. The apparatus of claim 1 wherein the second actuator is slidingly coupled to the plate.

10. The apparatus of claim 1 further comprising a controller in communication with the first and second actuators.

11. A method for selective actuation, comprising:

translating an index plate in a first direction in proximity to one or more containers arranged relative to one another and each having a corresponding lever arm, wherein the index plate defines one or more spaces over a surface of the plate and wherein each of the one or more spaces has a corresponding protrusion extending within such that one or more protrusions further define one or more columns which are arranged upon the plate at an angle and such that each protrusion is off-set relative to an adjacent protrusion along the column;

aligning a single protrusion relative to a single lever arm along a first direction; and translating the index plate in a second direction transverse to the first direction such that the single protrusion engages with the single lever arm.

12. The method of claim 11 wherein translating an index plate comprises translating the index plate within an enclosure in which the index plate and one or more containers are secured.

13. The method of claim 11 further comprising releasing a door upon actuation of the single lever arm.

14. The method of claim 13 wherein releasing the door comprises disengaging a locking mechanism via the lever arm.

15. The method of claim 13 further comprising releasing the one or more containers such that the one or more containers are slidable relative to the index plate.

16. The method of claim 13 further comprising sensing a release of the door.

17. The method of claim 11 wherein translating the index plate in a first direction comprises activating a first actuator to move the index plate along the first direction.

18. The method of claim 17 wherein translating the index plate in a second direction comprises activating a second actuator to move the index plate along the second direction.

19. The method of claim 11 further comprising translating a second index plate slidingly positioned adjacent to the index plate.

20. The method of claim 11 further comprising controlling translation of the index plate in the first direction and second direction via a controller.

* * * * *